US005418322A

United States Patent [19]

Minamitaka

[11] Patent Number: 5,418,322

[45] Date of Patent: May 23, 1995

[54] MUSIC APPARATUS FOR DETERMINING SCALE OF MELODY BY MOTION ANALYSIS OF NOTES OF THE MELODY

[75] Inventor: Junichi Minamitaka, Ome, Japan

[73] Assignee: Casio Computer Co., Ltd., Tokyo, Japan

[21] Appl. No.: 959,713

[22] Filed: Oct. 13, 1992

[30] Foreign Application Priority Data

Oct. 16, 1991 [JP] Japan ..... 3-294815

[51] Int. Cl.[6] ..... G10H 7/00

[52] U.S. Cl. ..... 84/609

[58] Field of Search ..... 84/609, 610, 634, 650

[56] References Cited

U.S. PATENT DOCUMENTS 4,951,544 8/1990 Minamitaka .

5,038,658 8/1991 Tsuruta et al. ..... 84/461

5,088,380 2/1992 Minamitaka ..... 84/637

*Primary Examiner*—William M. Shoop, Jr.

*Assistant Examiner*—Jeffrey W. Donels

*Attorney, Agent, or Firm*—Frishauf, Holtz, Goodman & Woodward

[57] ABSTRACT

A music apparatus determines a scale suitable for a given melody. The apparatus includes a motion analyzer which analyzes motion in the melody. In an embodiment, a note coupling evaluator evaluates a coupling coefficient of each note in the melody based on a pitch interval pattern of surrounding notes. Using the evaluated results, a tonic and type of a scale for the melody is determined.

9 Claims, 9 Drawing Sheets

MEL : START ADDRESS OF MELODY MEMORY

JOI : START ADDRESS OF NOTE COUPLING COEFFICIENT MEMORY

SAC : START ADDRESS OF SCALE PCS MEMORY

HIS : START ADDRESS OF HISTOGRAM MEMORY

SIN/BN : FITNESS DEGREE OF SCALE

MNO : NUMBER OF MELODY NOTES

SNO : NUMBER OF SCALES

KEY : TONIC (SCALE STARTING PITCH CLASS)

SCALE : SCALE TYPE

FIG. 2

| ADDRESS | DATA | INDICATE |
|---|---|---|
| MEL | 3fH | Eb5(PITCH) |
| MEL+1 | 2 | (LENGTH) |
| MEL+2 | 40H | E5 |
| | 2 | |
| | ffH | rest |
| | 2 | |
| | 40H | E5 |
| | 2 | |
| | 3fH | Eb5 |
| | 2 | |
| | 40H | E5 |
| | 2 | |
| | 42H | Gb5 |
| | 2 | |
| | 43H | G5 |
| | 2 | |
| | ffH | rest |
| | 2 | |
| | 43H | G5 |
| | 2 | |
| | 45H | A5 |
| | 2 | |
| | 43H | G5 |
| | 2 | |

4

FIG. 3

| ADDRESS | DATA | INTERVAL |
|---|---|---|
| JOI | 100 | p1(PERFECT FIRST UP) |
| JOI+1 | 100 | (DOWN) |
| JOI+2 | 180 | m2(MINOR SECOND UP) |
| | 50 | (DOWN) |
| | 80 | M2(MAJOR SECOND UP) |
| | 120 | |
| | 100 | m3(MINOR THIRD UP) |
| | 70 | |
| | 80 | M3(MAJOR THIRD UP) |
| | 120 | |
| | 160 | p4(PERFECT FOURTH UP) |
| | 50 | |
| | 10 | d5(DIMINISHED FIFTH UP) |
| | 10 | |
| | 40 | p5(PERFECT FIFTH UP) |
| | 160 | |
| | 30 | m6(MINOR SIXTH UP) |
| | 30 | |
| | 20 | M6(MAJOR SIXTH UP) |
| | 20 | |
| | 10 | m7(MINOR SEVENTH UP) |
| | 10 | |
| | 10 | M7(MAJOR SEVENTH UP) |
| | 10 | |

5

FIG. 4

| ADDRESS | DATA (B A | G FE | D C) | SCALE TYPE |
|---|---|---|---|---|
| SCA | ****1010 | 1011 | 0101 | Ionian |
| SCA+1 | ****0110 | 1010 | 1101 | Dorian |
| SCA+2 | ****0101 | 1010 | 1011 | Phrygian |
| | ****1010 | 1101 | 0101 | Lydian |
| | ****0110 | 1011 | 0101 | Mixolydian |
| | ****0101 | 1010 | 1101 | Aeolian |
| | ****0101 | 0110 | 1011 | Locrian |
| | ****1001 | 1010 | 1101 | Harmonic Minor |
| | ****1010 | 1010 | 1111 | Melodic Minor |
| | ****1011 | 0110 | 1101 | Diminish |
| | ****0101 | 0101 | 1011 | Altered Dominant |
| | ****0101 | 1011 | 0011 | Harmonic Minor P 5th Below |
| | ****1000 | 1011 | 0001 | Penta Tonic(1) |
| | ****1010 | 1011 | 0101 | Penta Tonic(2) |
| | ****0010 | 1010 | 0101 | Penta Tonic(3) |
| | ****0001 | 1010 | 0011 | Penta Tonic(4) |

6

FIG. 5

MUSIC APPARATUS FOR DETERMINING SCALE OF MELODY BY MOTION ANALYSIS OF NOTES OF THE MELODY

This invention pertains to music apparatus. In particular, the invention relates to an apparatus which analyzes a melody to derive a scale suitable for it.

An apparatus is known which determines a key of a given melody. A prior art key determining apparatus generates twelve major scales each having a different tonic selected from twelve pitch classes C to B. The apparatus matches a pitch class set of each major scale against that of a given melody to compute a matching degree therebetween. A major scale with the highest matching degree is found to be the key of the given melody.

This prior art has the following disadvantages.

(A) In music, a non-major scale (with a different pitch class set from that of a major scale) can be suitable for a melody. The prior art disregards this fact so that it cannot provide satisfactory determination of a scale for a melody.

(B) The prior art considers a melody as a mere (pitch class) set of notes. On this premise, it tests matching of the melody note set against the pitch class set of a scale for scale determination. In other words, the prior art ignores movement or motion in a melody from one note to another. This also limits the scale determination capability of the prior art.

SUMMARY OF THE INVENTION

The invention contemplates motion in a melody to determine a scale suitable for it. In doing so, the invention provides an improved apparatus having an increased capability of scale determination.

In accordance with the invention, there is provided an apparatus which comprises melody providing means for providing a melody, motion analyzing means for analyzing a motion of the melody, and scale determining means for determining a scale of the melody based on the analyzed motion.

The scale determining means may comprise tonic determining means for determining a tonic of the scale, and type determining means for determining a type of the scale.

The motion analyzing means may comprise pitch interval computing means for computing a pitch interval formed between adjacent notes in the melody to thereby provide a succession of pitch intervals, coupling coefficient evaluating means for evaluating a coupling coefficient of each note in the melody based on the succession of pitch intervals, and accumulating means for accumulating the evaluated coupling coefficient for each pitch class.

The coupling coefficient of a note indicates a function of the note in the context of the melody. It is expected that those notes having a higher coupling coefficient constitute or closely correlate with a suitable scale for the melody.

The motion analyzing means may further comprise accumulating means for accumulating evaluated coupling coefficients for each pitch class to thereby provide a histogram.

In an embodiment, the tonic determining means comprises means for finding, as the tonic (starting note of a scale), a pitch class having a maximum of accumulated coupling coefficients in the histogram. The type determining means comprises scale storage means for storing a pitch class set of a plurality of scale types for each type, transposing means for transposing, for each type, the stored pitch class set according to the determined tonic, and scale evaluating means for evaluating, for each type, the transposed pitch class set based on the histogram to thereby find a scale that best fits the melody.

The transposing means serves to minimizes the amount of scale data.

Coupling coefficient storage means may be provided which stores data of coupling coefficients each defined between two notes as a function of a pitch interval formed therebetween. Based on the stored data and the succession of pitch intervals of the melody, a coupling coefficient of each melody note is evaluated.

A modified coupling coefficient storage means stores data of coupling coefficients each defined for a note placed in a pattern of pitch intervals. The pattern of pitch intervals is formed by the note and its surrounding notes. Thus the pattern of pitch intervals indicates a musical context of the note. Pattern matching means applies a pattern of melody pitch intervals from the pitch interval computing means to the modified coupling coefficient storage means to find a matching pattern in the storage means to thereby obtain a coupling coefficient of each note in the melody.

BRIEF DESCRIPTION OF THE DRAWINGS

FIG. 2 shows variables and constants used in the music apparatus of FIG. 1 for determining a scale;

FIG. 3 is a map of the melody memory in FIG. 1;

FIG. 4 is a map of the note coupling coefficient memory in FIG. 1;

FIG. 5 is a map of the scale PCM memory in FIG. 1;

DETAILED DESCRIPTION OF THE PREFERRED EMBODIMENT

Figure 1:
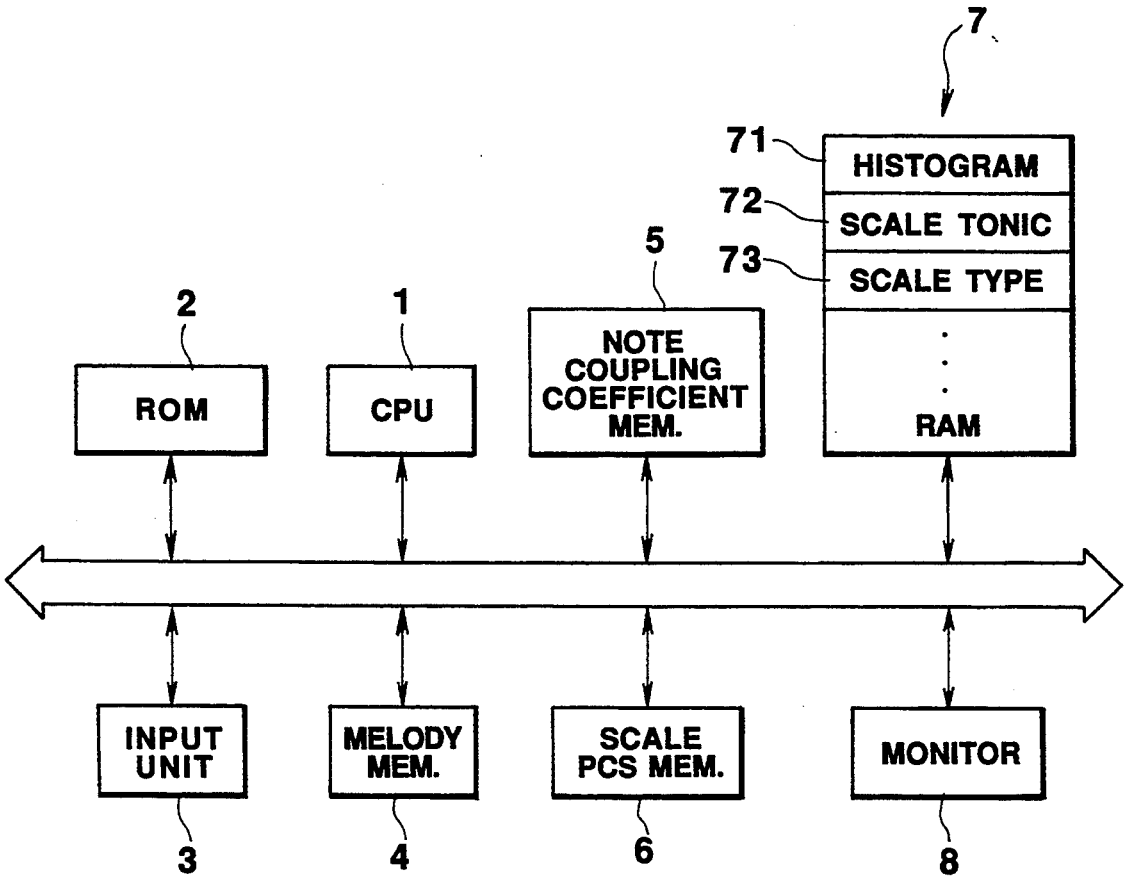
FIG. 1 is a block diagram of a music apparatus for determining a scale of a melody in accordance with an embodiment of the invention.

Referring first to FIG. 1, there is shown a block diagram of a music apparatus for determining a scale of a melody in accordance with an embodiment of the invention. CPU 1 operates according to a program stored in a program ROM 2 to control the system components. An input unit 3 enters a melody and other information. A musical keyboard may be used to enter a melody. A melody memory 4 (implemented by RAM) stores data of a melody entered from the input unit 3. In accordance with the invention, there is provided a note coupling coefficient memory 5 (implemented by ROM). The note coupling coefficient memory 5 stores data of coupling coefficients each defined between two notes as a function of a pitch interval formed therebetween. A scale PCS memory 6 (configured in ROM) stores a pitch class set (PCS) of a plurality of scales for each scale type. Each scale has a predetermined tonic (scale starting note), for example, C. Each pitch class set defines a pitch intervalic structure of a scale type. RAM 7 includes a histogram memory 71, a tonic memory 72 and a scale type memory 73. The histogram memory 71 stores a histogram of coupling coefficients of the melody notes accumulated for each pitch class. The tonic memory 72 stores a tonic (starting note) of a scale for the melody. The scale type memory 73 stores the type of the scale. A monitor 8 includes a display and a sound generator, and is used to monitor the results of scale determination.

In operation, CPU 1 reads melody data from the melody memory 4 to generate a pitch interval succession of the melody. Then CPU 1 evaluates a coupling coefficient of each note in the melody based on the pitch interval succession and the note coupling coefficient data in the memory 5. The evaluated coupling coefficients are accumulated for each pitch class to thereby generate a histogram. In the histogram, a pitch class having the highest coupling coefficient is selected as a tonic of a scale for the melody. Each scale PCS in the scale PCS memory 6 is transposed according to the selected tonic. The coupling coefficients of each transposed scale PCS are evaluated in the histogram to determine the scale of the melody.

FIG. 2 shows variables and constants used by the music apparatus of FIG. 1 for determining a scale of a melody. A constant MEL indicates the start address of the melody memory 4. A constant JOI indicates the start address of the note coupling coefficient memory 5. A constant SCA indicates the start address of the scale PCS memory 6. A constant HIS indicates the start address of the histogram memory 71. A variable SIM/BN indicates a fitness degree of a scale for a melody. A variable MNO indicates the number of the melody notes. A constant SNO indicates the number of scales stored in scale PCS memory 6. A variable KEY indicates a scale tonic determined and stored in the tonic memory 72. A variable SCALE indicates a scale type determined and stored in the scale type memory 73. The scale tonic and type define a scale suitable for the melody stored in the melody memory 4.

FIG. 3 illustrates melody data stored in the melody memory 4. As shown, an even adress of the melody memory 4 stores a pitch while an odd address stores a note length.

FIG. 4 illustrates the note coupling coefficient memory 5. As shown, the note coupling coefficient memory 5 is a look-up table which returns a coupling coefficient when looked up by a pitch interval. Thus, the coupling coefficient is a function of a pitch interval, and indicates a coupling degree between two notes having such a pitch interval. Each address of the note coupling coefficient memory 4 indicates a pitch interval. Twelve even addresses of the memory 4 store note coupling coefficients for twelve pitch intervals of ascending motion while twelve odd addresses store coupling coefficients for twelve pitch intervals of descending motion.

FIG. 5 illustrates the scale PCS memory 6. The scale PCS memory 6 stores a pitch class set (PCS) of a plurality scales. Each scale PCS is assumed to have a tonic of C, and is represented by the lowest twelve bits in a sixteen-bit word. Bit 0 of the lowest twelve bits indicates a pitch class of C, bit 1 indicates a pitch class of C#, and so on until bit 11 indicates a pitch class of B. If a bit has a value of "1", it indicates a scale note or member. According to this format, Ionian scale having a pitch class set of C, D, E, F, G, A and B is represented by the twelve bit PCS data as follows.

101010110101

Figure 6:
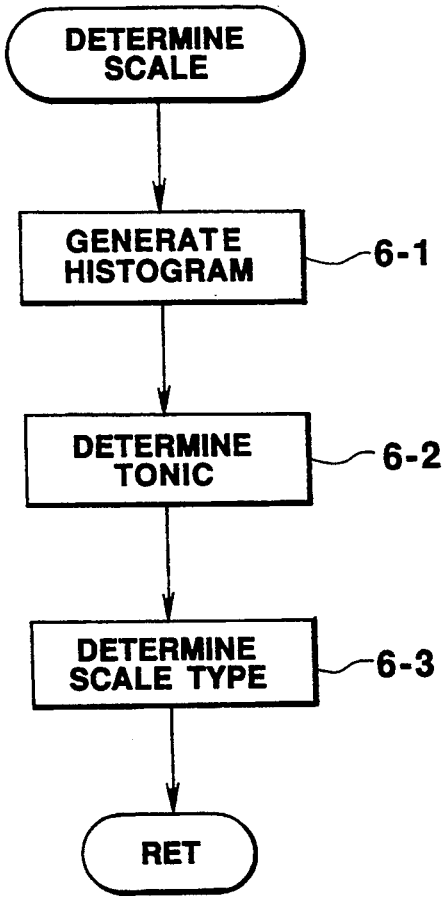
FIG. 6 is a flow chart of a determine scale routine, illustrating the operation of the music apparatus in FIG. 1.

FIG. 6 is a flow chart of a determine scale routine to be executed by CPU 1. The determine scale routine comprises a generate histogram block 6-1, a determine tonic block 6-2 and a determine scale type block 6-3.

Figure 7:
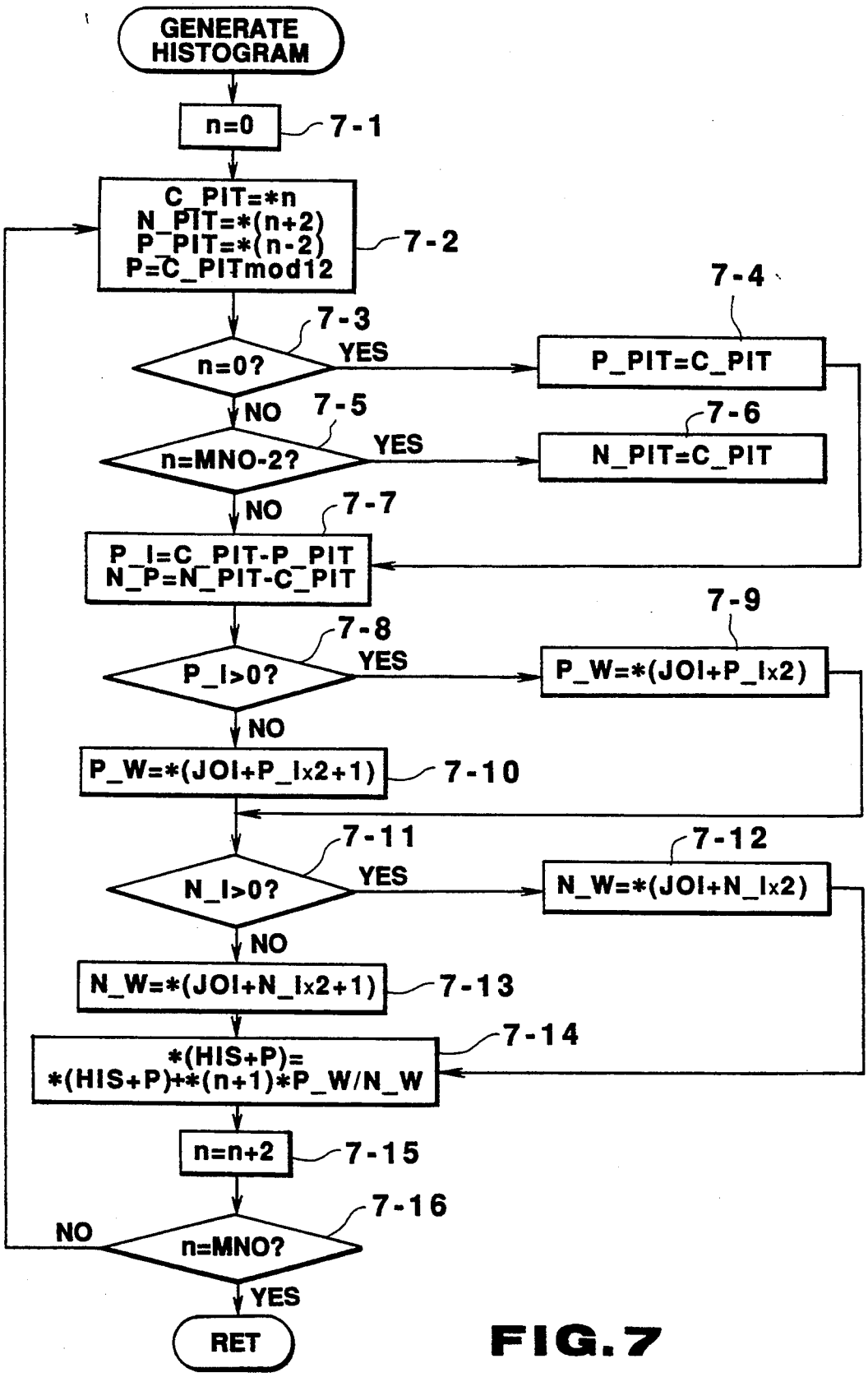
FIG. 7 is a flow chart of a generate histogram routine.

FIG. 7 shows the details of the generate histogram block 6-1. This block evaluates a coupling coefficient of each note in the melody by:

coupling coefficient = (note length) × coupling coefficient from preceding note/ coupling coefficient to succeeding note To get the coupling coefficient from the preceding note, a pitch interval from the preceding note is computed and a coupling coefficient corresponding to the computed pitch interval is read out from the note coupling coefficient memory 5. The coupling coefficient to the succeeding note is obtained in a similar manner.

The evaluated coupling coefficients are accumulated for each pitch class to create a histogram in the histogram memory 71.

Specifically, step 7-1 initializes the address pointer n of the melody memory 4 to "0." The entry 7-2 of the loop reads from the melody memory 4 a current melody note pitch C_PIT, a succeeding note pitch N_PIT and a preceding note pitch P_PIT, and gets the pitch class of the current note P by $$C_PIT = *n$$

$$N_PIT = *(n+2)$$

$$P_PIT = *(n-2)$$

$$P = C_PIT \bmod 12$$

If the current note is the first note of the melody, its preceding note is assumed to have the same pitch as that of the current note (7-3, 7-4). If the current note is the last note of the melody, it is assumed that a note of the same pitch as the last note pitch succeeds the last note (7-5, 7-6). Step 7-7 computes a pitch interval P_I from the preceding to current notes and a pitch interval N_P from the current to succeeding notes by:

$$P_I = C_PIT - P_PIT$$

$$N_P = N_PIT - C_PIT$$

If the pitch interval P_I from the preceding note indicates an ascending motion (pitch increase in moving from the preceding note to the current), the coupling coefficient P_W from the preceding note is read from the note coupling coefficient memory 5 by P_W=*-(JOI+P_I×2+1), as indicated in steps 7-8 and 7-10. In a similar manner, the coupling coefficient N_W to the succeeding note is read from the note coupling coefficient memory (7-11 to 7-13). Step 7-13 evaluates the coupling coefficient of the current note by $$*(n+1) \times P_W / N_W$$

in which *(n+1) indicates the length of the current note, P_W indicates the coupling coefficient from the preceding note and N_W indicates the coupling coefficient to the succeeding note. Then step 7-13 adds the evaluated coupling coefficient of the current note to an element of the histogram for the pitch class of the current note by $$*(HIS+P)=*(HIS+P)+*(n+1)\times P_W/N_W$$

Step 7-15 locates the next note in the melody memory 4. The loop of steps 7-2 to 7-16 repeates until step 7-16 finds the end of the melody by n=MNO. As a result, the histogram memory 71 stores a histogram of melody note coupling coefficients accumulated for each pitch class.

Figure 8:
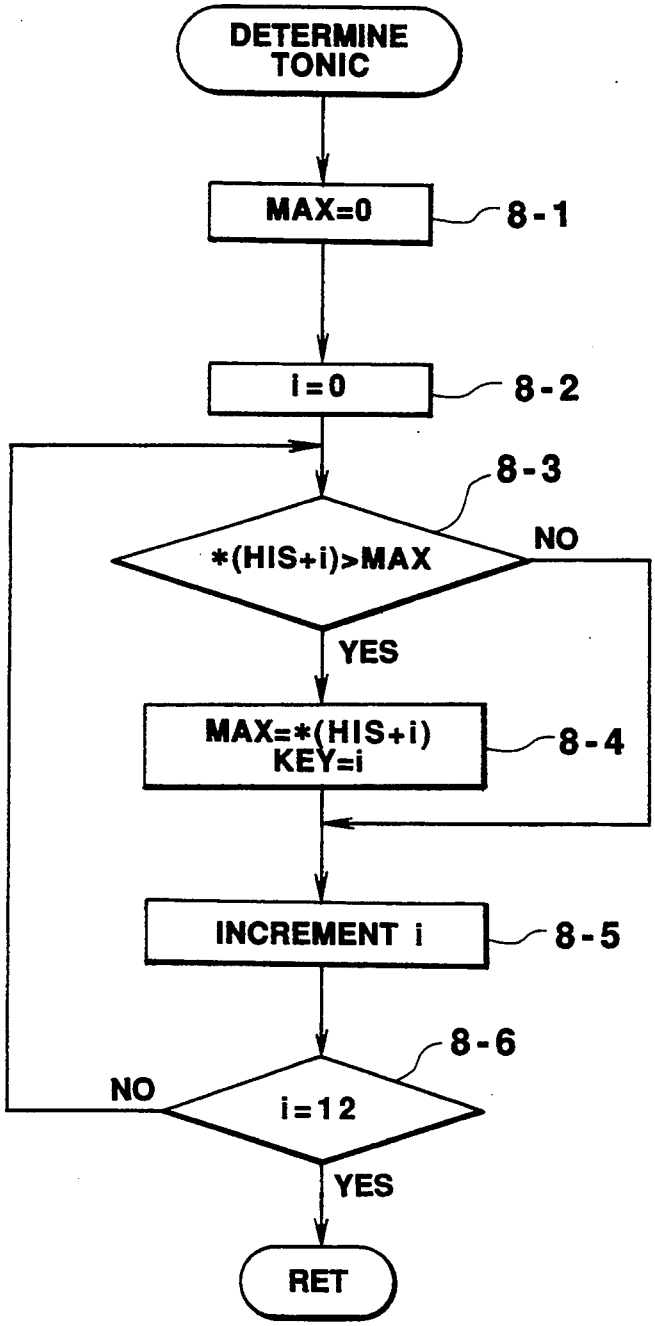
FIG. 8 is a flow chart of a determine tonic routine.

FIG. 8 shows a detailed flow chart of the determine tonic block 6-2. This block finds a pitch class in the histogram, having the maximum coupling coefficient. This pitch class defines the tonic (starting note) of a scale for the melody.

Specifically, step 8-1 initializes a maximum variable MAX to "0." Step 8-2 initalizes pitch class variable i to "0" indicative of C. Entry 8-3 of the loop 8-3 to 8-6 compares an accumulated coupling coefficient *(HIS+i) i.e., an element in the histogram for the pitch class i with MAX. If *(HIS+i) is greater than MAX, step 8-4 updates MAX to *(HIS+i) and sets a tonic variable KEY to the pitch class i. Step 8-5 increments i. The loop 8-3 to 8-6 repeats for all pitch classes (8-6).

In this manner, a scale tonic of the melody is determined and stored in KEY memory 72.

Figure 9:
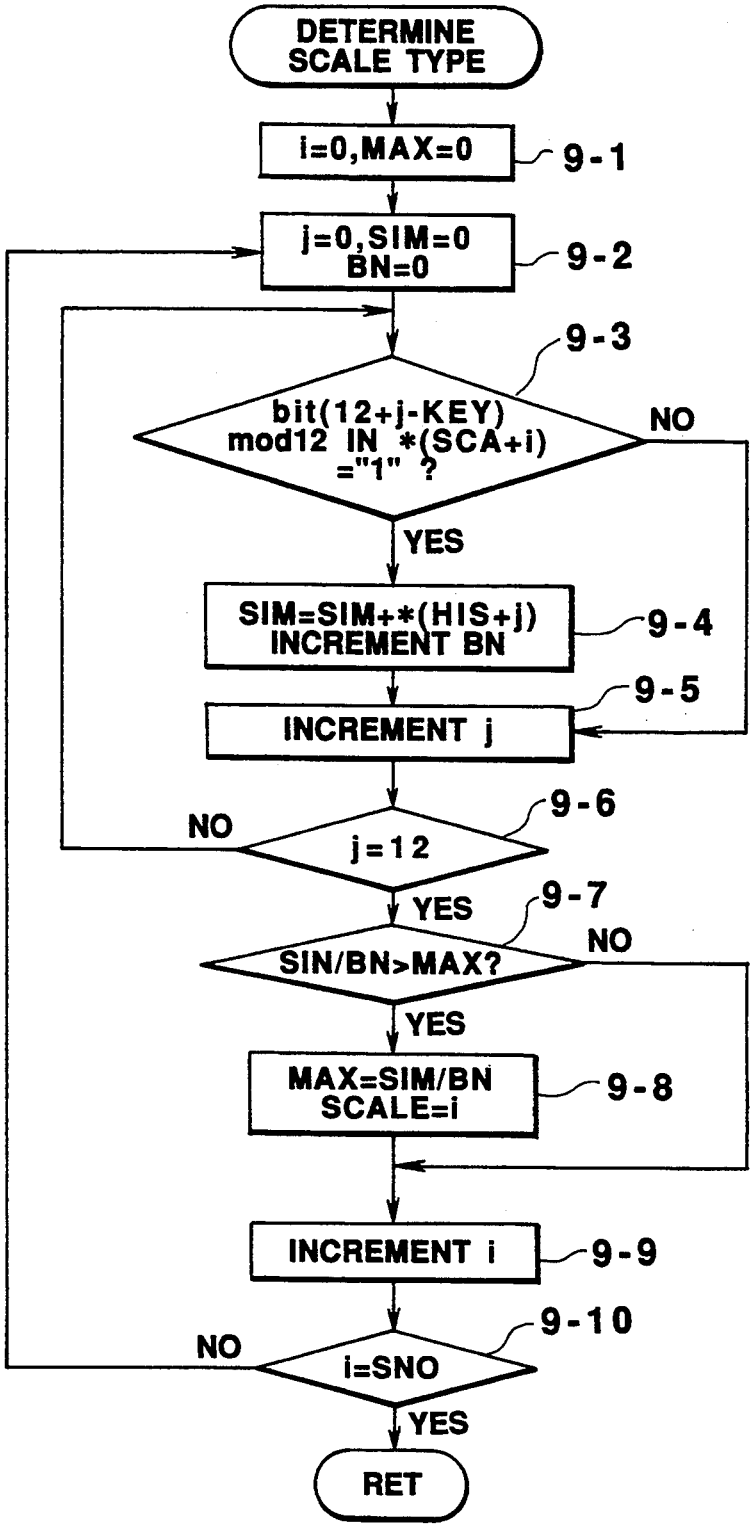
FIG. 9 is a flow chart of a determine scale type routine.

FIG. 9 shows a detailed flow chart of the determine scale type block 6-3. This block transposes each scale PCS in the scale PCS memory 6 according to the determined scale tonic. Using the histogram, the block 6-3 evaluates an average of the coupling coefficient for each transposed scale PCS. A scale having the highest average determines the scale type for the melody.

Specifically, step 9-1 initializes a scale type counter i and a maximum variable MAX to zeros. Entry 9-2 of the outer loop 9-2 to 9-10 initializes a pitch class counter j, coupling coefficient accumulator SIM of scale PCS, and a scale note counter BN to zeros. The inner loop 9-3 to 9-6 computes an accumulated coupling coefficient SIM and the number of scale notes for a scale PCS designated by scale type i and transposed to the determined tonic KEY. Step 9-3 checks if a bit (12+j-KEY) mod 12 is "1" to see whether the pitch class "j" is a member (note) of the scale transposed to KEY. If the pitch class j is a member of the scale, step 9-4 reads from the histogram a coupling coefficient for the pitch class j, adds it to SIM and increment the scale note counter BN. Step 9-5 increments the pitch class counter. The inner loop repeats until all pitch classes have been scanned (9-6). As a result, BN is set to the number of the notes of a scale and SIM is set to the accumulated coupling coefficient of the scale.

Step 9-7 evaluates the fitness degree of the scale for the melody by computing an average coupling coefficient SIM/BN of the scale. Further, step 9-7 compares the fitness degree SIM/BN with MAX. If SIM/BN is greater than MAX, step 9-8 updates MAX to SIM/BN and sets SCALE to the scale type i. Step 9-9 increments the scale type i to locates the nexts scale in the scale PCS memory 6. The loop 9-2 to 9-10 repeates until all scales in the scale PCS memory 6 have been tested (9-10).

As a result, SCALE memory 73 stores a scale type having the highest fitness degree for the melody.

This concludes the detailed description of the invention. However, various modifications and applications will be obvious to those skilled in the art.

For example, the specific embodiment first determines a scale tonic from the histogram of coupling coefficients, and then determines a scale type from scales transposed to the scale tonic. In the alternative, scale PCS data for the scale PCS memory may be transposed to all possible scales. Then correlation between each transposed scale PCS and the histogram may be evaluated to simultaneously determine a tonic and type of a scale for the melody.

The note coupling coefficient memory may be modified such that it stores coupling coefficients each for a note in a three or more note succession. For example, in a three-note succession (of preceding, current and succeeding notes), the stored coupling coefficient of the current note may be defined as a function of the durational pattern and pitch interval pattern of the three-note succession to realize a three-note coupling coefficient memory. CPU 1 gets a coupling coefficient of each note in the melody by looking up the three-note coupling coefficient memory.

The invention may apply to an automatic performing apparatus which performes a secondary melody or an accompaniment. For example, an accompaniment pattern memory is provided which stores accompaniment patterns each for a particular scale type and musical style. In operation, from the preselected style and the scale determined from a melody in accordance with the invention, a corresponding accompaniment pattern is read out from the pattern memory for automatic accompaniment.

Therefore, the scope of the invention should be limited only by the appended claims.

What is claimed is:

1. An apparatus for determining a scale of a melody, comprising:

melody providing means for providing a melody;

motion analyzing means for analyzing motion in said melody; and scale determining means for determining a scale of said melody based on said analyzed motion.

2. The apparatus of claim 1 wherein said scale determining means comprises:

tonic determining means for determining a tonic of said scale; and type determining means for determining a type of said scale.

3. An apparatus for determining a scale of a melody, comprising:

melody providing means for providing a melody;

motion analyzing means for analyzing motion in said melody; and scale determining means for determining a scale of said melody based on said analyzed motion; and wherein said motion analyzing means comprises:

pitch interval computing means for computing a pitch interval formed between adjacent notes in said melody to thereby provide a succession of pitch intervals; and coupling coefficient evaluating means for evaluation a coupling coefficient of each note in said melody based on said succession of pitch intervals.

4. The apparatus of claim 3 wherein said scale determining means comprises:

tonic determining means for determining a tonic of said scale; and type determining means for determining a type of said scale.

5. An apparatus for determining a scale of a melody, comprising:

melody providing means for providing a melody;

coupling coefficient storage means for storing data of coupling coefficients each defined between at least two notes as a function of a pitch interval;

pitch interval computing means for computing a pitch interval formed between adjacent notes in said melody;

histogram generating means for accumulating coupling coefficients of notes in said melody for each pitch class based on results from said interval computing means and data of coupling coefficients from said coupling coefficient storage means to thereby generate a histogram of accumulated coupling coefficients; and scale determining means for determining a scale of said melody based on said histogram.

6. The apparatus of claim 5 wherein said scale determining means comprises:

tonic determining means for determining a tonic of said scale; and type determining means for determining a type of said scale.

7. The apparatus of claim 6 wherein said tonic determining means comprises means for finding, as said tonic, a pitch class having a maximum of accumulated coupling coefficients in said histogram.

8. The apparatus of claim 7 wherein said type determining means comprises:

scale storage means for storing a pitch class set of a plurality of scale types for each type;

transposing means for transposing, for each type, said stored pitch class set according to said determined tonic; and scale evaluating means for evaluating, for each type, said transposed pitch class set based on said histogram to thereby find a scale that best fits said melody.

9. An apparatus for determining a scale of a melody, comprising:

melody providing means for providing a melody;

coupling coefficient storage means for storing data of coupling coefficients each defined between two notes as a function of a pitch interval formed therebetween;

pitch interval computing means for computing a pitch interval formed between adjacent notes in said melody to thereby provide a succession of pitch intervals;

evaluating means for evaluating a coupling coefficient of each note in said melody based on said stored data in said coupling coefficient storage means and said succession of pitch intervals from said pitch interval computing means;

accumulating means for accumulating said evaluated coupling coefficient for each pitch class to thereby provide a histogram;

tonic determining means for determining a tonic of a scale of said melody based on said histogram;

scale storage means for storing a pitch class set of a plurality of scales for each scale; and selecting means for selecting, from among said plurality of scales, a scale suitable for said melody based on said stored pitch class set of said plurality of scales and said determined tonic.

* * * * *